United States Patent [19]

Shoemaker

[11] Patent Number: 5,018,653

[45] Date of Patent: May 28, 1991

[54] FRONT DRAW HANDGUN HOLSTER

[76] Inventor: Randy R. Shoemaker, 4819 St. Andres, LaVerne, Calif. 91750

[21] Appl. No.: 361,256

[22] Filed: Jun. 5, 1989

[51] Int. Cl.[5] ..... F41C 33/02

[52] U.S. Cl. ..... 224/198; 224/193; 224/253; 224/911

[58] Field of Search ..... 224/193, 192, 253, 911, 224/912, 198, 197, 199, 200

[56] References Cited

U.S. PATENT DOCUMENTS

| | | | |
|---|---|---|---|
| 2,347,006 | 4/1944 | Tibbetts | 224/193 |
| 3,902,639 | 9/1975 | Rogers | 224/193 |
| 3,915,361 | 10/1975 | Perkins | 224/198 |
| 4,065,039 | 12/1977 | Bianchi et al. | 224/193 |
| 4,084,734 | 4/1978 | Bianchi et al. | 224/193 |
| 4,303,185 | 12/1981 | Shoemaker | 224/193 |
| 4,504,001 | 3/1985 | Nichols | 224/198 |
| 4,759,483 | 7/1988 | Willoughby | 224/911 |
| 4,874,118 | 10/1989 | Parlante | 224/198 |

*Primary Examiner*—Linda J. Sholl

*Attorney, Agent, or Firm*—Boniard I. Brown

[57] ABSTRACT

A front opening, front fast draw handgun holster whose side wall portions are adjustable toward one another to adjustably grip a handgun in the holster in order to prevent the gun from falling from the holster during strenuous physical activity of the wearer or being grabbed from the holster by another person, and adjustable away from one another to release the gun for fast front draw as well as upward removal from the holster. A holster which is angularly adjustable relative to the wearer's body in such a way as to permit each wearer to adjust the holster to the best position.

4 Claims, 2 Drawing Sheets

84
66
56b
82
80
78
72
16
74
70
76
14
56a
20
50
18
58
12
24

52
20
50
18
44

72
42
84
18
28
54
46
26
82
12

22
76
44
52
8
8
78
78
14
68
9
9
80
74
66
72
70
20
56c 56e
56
56b
56d
56a

FRONT DRAW HANDGUN HOLSTER

BACKGROUND OF THE INVENTION

1. Field of the Invention

This invention relates generally to handgun holsters to be worn on the hip, and more particularly to an improved front opening, front draw holster whose sides are adjustable to firmly grip the holstered gun and thereby retain the gun in the holster when neccessary and to release the gun for rapid front draw. The invention also relates to a holster which is adjustable to various angular positions relative to the wearer's body.

2. Discussion of the Prior Art

Holsters for active duty use by law enforcement officers, security personnel, and the like and competition holsters which are worn on the hip present three important requirements with which the present invention is concerned. These requirements are (1) effective securement of the holstered gun against falling from the holster, particularly during periods of strenuous physical activity of the wearer, and against grabbing of the gun from the holster by another person, (2) capability of rapidly drawing and firing the holstered gun when necessary, and (3) capability of being worn high on the wearer's hip.

The existing hip holsters of which I am aware satisfy one or two but not all three of these requirements. These existing holsters are of two basic types, namely top opening, top draw holsters and front opening, front draw holsters. Top draw holsters have a top opening only and require complete upward withdrawal of the gun from the holster through this top opening for firing. Many of these top draw holsters have means for securing the holstered gun against accidental movement from the holster and removal of the gun by another person and thus satisfy requirement (1) above. For example, one type of existing top draw holster has means extending between the inner and outer side portions of the holster for adjusting these side portions toward and away from one another in such a way as to grip the holstered gun with an adjustable force and release the gun. Many holsters of this kind are also designed to facilitate fast draw of a gun from the holster for firing and thereby satisfy requirement (2) above.

Top draw holsters have one disadvantage, however, in that they cannot be worn high on the hip and thus fail to satisfy requirement (3) above. Thus, fast and safe withdrawal of a holstered gun from a top draw holster requires the holster to be worn quite low on the wearer's hip in order to provide the wearer with sufficient freedom of arm movement to quickly and safely withdraw the gun upwardly from the holster, particularly when sitting. Wearing a holster in such a low position, however, is quite uncomfortable. It is much more comfortable to wear a holster relatively high on the hip in accordance with requirement (3) above.

My prior U.S. Pat. No. 4,303,185 discloses a front opening, front draw holster. This type of holster is designed to be comfortably worn high on the hip and yet permit rapid and safe firing of a holstered gun even when the wearer is in a sitting position. To these ends, a front draw holster has a front opening in addition to the usual top opening. Such a front opening, front draw holster permits firing of a holstered gun, without actually removing it from the holster, by simply grasping the upper gun handle and rotating the handle rearwardly and downwardly in such a way as to rotate the gun barrel forwardly and upwardly through the front holster opening to a firing position wherein the barrel projects forwardly through the front opening. The existing front opening, front draw holsters, however, lack means for adjustably gripping the holstered gun between the holster side portions when necessary to secure the gun in the holster and resort, instead, to a strap or the like, such as that shown in my prior patent, to secure the gun in the holster.

From this discussion, it will be appreciated that top draw holsters are known which secure a holstered gun worn on the wearer's hip against accidental separation from its holster and against grabbing of the gun from the holster by another person and which have at least some degree of fast draw capability. These holsters, however, must be worn relatively low on the wearer's hip and are thus uncomfortable. On the other hand, front draw holsters are known which have quick draw capability and can be comfortably worn high on the hip but do not provide means for adjustably gripping and releasing the holstered gun in such a way as to securely resist accidental separation and grabbing of the gun from the holster. Accordingly, there is a definite need for an improved front opening, front draw holster of the character described.

SUMMARY OF THE INVENTION

According to one of its aspects, this invention provides such an improved front opening, front draw holster which can be comfortably worn high on the wearer's hip. This improved holster has a holster body with inner and outer side portions, a customary top opening, and a front opening. The holster receives a handgun in a holstered position wherein the gun barrel extends downwardly between the holster side portions and just to the rear of the front opening. The gun handle is exposed above the open upper end of the body. The gun may be withdrawn through the upper end cf the holster, if desired. However, the holster is especially designed to permit fast front draw of the gun for firing without actually removing the gun from the holster in somewhat the same manner as in the front opening holster of my prior U.S. Pat. No. 4,303,185. This fast front draw is accomplished by grasping the gun handle and rotating the handle rearwardly and downwardly in such a way as to rotate the gun barrel forwardly and upwardly though the holster front opening to a firing position wherein the barrel extends forwardly through the front opening.

According to one improved feature of the invention, the holster embodies adjustment means for effecting adjustment of the holster side portions toward and away from one another to adjustably grip the holstered gun in order to resist accidental loss of the gun from the holster either falling from the holster or by another person grabbing the gun from the holster and to release the gun for fast front draw and removal from the holster. In the presently preferred holster of the invention, this adjustment means comprises a threaded connection which joins the holster side portions and is adjustable to urge the side portions toward one another against the bias of a spring wire within the side portions. Front sections of this spring wire extend along the edges of the holster front opening to normally retain these edges in close proximity to one another and permit yieldable separation of the edges when the gun barrel is forced through the opening during a front draw of the gun.

The holster may be designed to receive a pistol or a revolver. The adjustable connection between the holster side portions provides a support on which the trigger guard of a holstered pistol rests to support the gun in the holster. The holster spring shapes the holster side portions to form a pocket which opens upwardly to the top opening of the holster body for receiving the revolver cylinder and a ledge at the bottom of the pocket on which the cylinder rests to support the gun in the holster.

Attached to the inner side portion of the holster body are means for attaching the holster to a wearer, such as to a belt worn by the wearer. According to another improved feature of the invention, this attaching means is uniquely constructed and arranged to permit angular adjustment of the holster relative to the wearer's body about an axis passing through and substantially normal to the holster side portions.

DESCRIPTION OF THE PREFERRED EMBODIMENT

Figure 1:
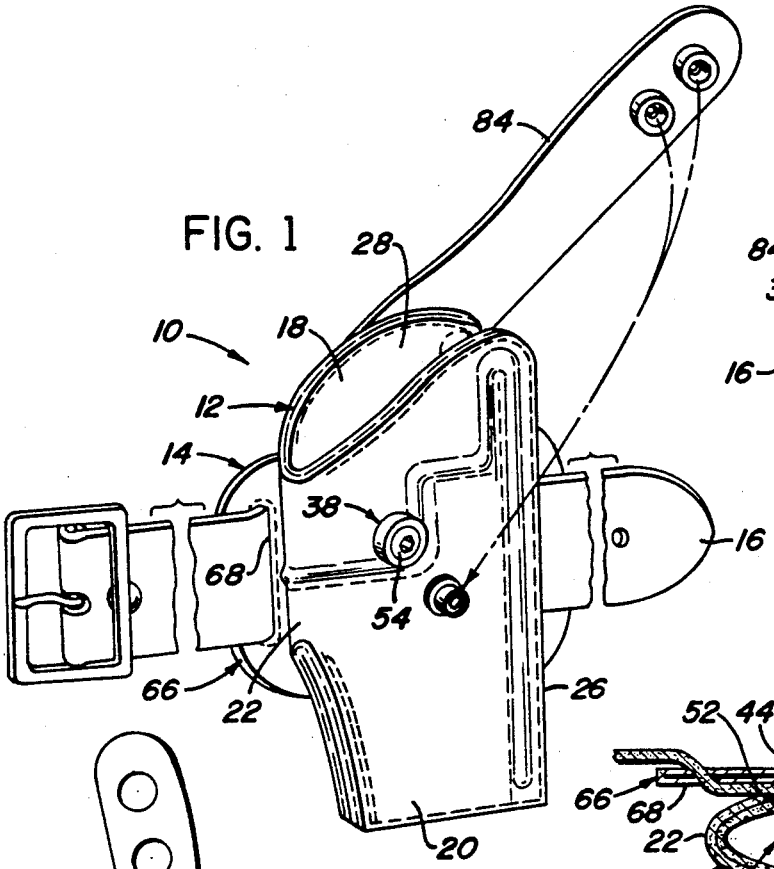
FIG. 1 is a perspective view of a presently preferred front opening, front draw holster according to the invention attached to a belt to be worn by the holster user.

The improved front opening, front draw holster 10 of the invention has a holster 12 proper, referred to herein as the holster body, and means 14 for attaching the holster to the wearer. The illustrated holster is attached to a belt 16 to be worn about the wearer's waist in such a way that the holster will be located relatively high on the wearer's hip and thus comfortable to wear.

The holster body 12 has inner and outer side portions 18, 20, respectively, which form side walls of the body and are integrally joined along the rear side or edge of the body by an arcuate web portion 22 which form a rear connecting wall of the body joining the side walls. The side portions 18, 20 are separated along the front side or edge of the holster body to form a front opening 24 in the body which extends from the top to the bottom of the body. The side portions 18, 20 have front edges 26 which define therebetween and bound the front opening 24. The top end of the holster body 12 has an opening 28.

Figure 4:
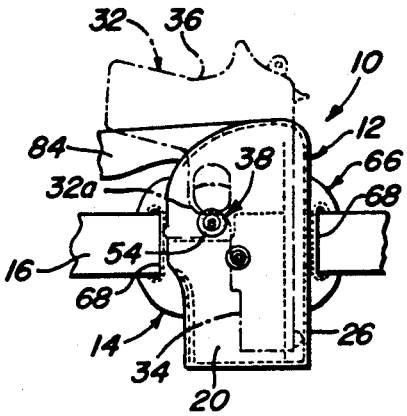
FIG. 4 is a side view of the holster on reduced scale with an automatic pistol positioned in the holster.
Figure 3:
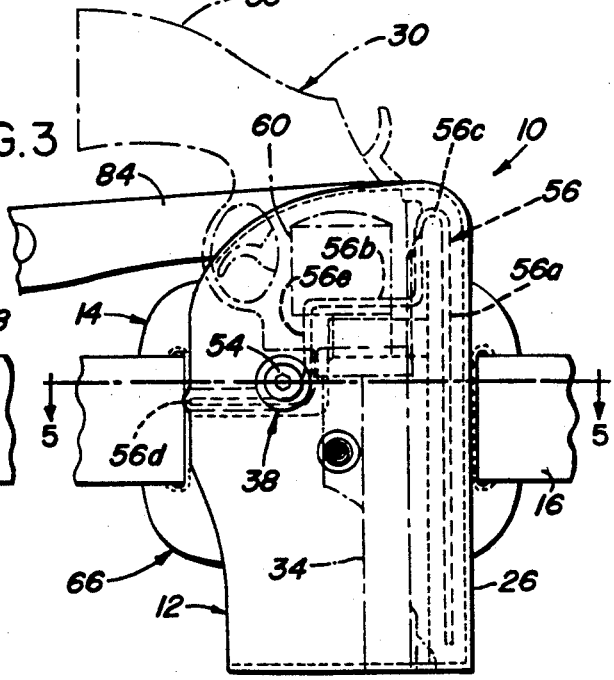
FIG. 3 is a side view of the holster with a revolver positioned in the holster.

The holster is designed to receive either a revolver 30, as shown in FIG. 3, or a pistol 32, as shown in FIG. 4. In each case, the gun is positioned in the holster body 12 with the gun barrel 34 extending downwardly through the body between the body side portions 18, 20 and with the gun handle 36 exposed above the top opening 28 of the body. The gun is inserted into and removed from the holster through this top opening.

According to one important improvement of the invention, the present front opening, front draw holster 10 is provided with adjustment means 38 for effecting adjustment of the holster side portions 18, 20 toward and away from one another to adjustably grip and release the holstered gun 30 or 32. The preferred adjustment means illustrated comprises a threaded, axially adjustable connection 40 extending between and joining generally central regions of the side portions 18, 20. A resilient sleeve 42 surrounds the connection between the side portions. The threaded connection 40 comprises a threaded nut 44 secured to the inner side portion 18 and a screw 46 extending through a hole 48 in the outer side portion 20 and threaded in the nut 44. As shown best in FIGS. 5, 6, and 8 of the drawings, the side portions 18, 20 have two layers or thicknesses 50 which are joined or bonded to one another in any suitable way. The nut 44 has a flange 52 (FIG. 8) at one end which is disposed between the two layers 50 of the inner side portion 18 and serves to firmly secure the nut to the latter side portion. The screw 46 has a head 54 which is accessible at the outer side of the holster and bears against the outer surface of the outer holster side portion 20.

From the above description of the adjustment means 38 and from the drawings, it will be understood that rotation of the adjustment screw 46 in a direction to thread the screw into the nut 44 (hereafter referred to as tightening the screw) urges the holster side portions 18, 20 toward one another, thereby compressing the resilient adjustment sleeve 42 between the side portions. Rotation of the screw 46 in the opposite direction to unthread the screw from the nut (hereafter referred to as loosening the screw) releases the side portions to separate under the bias of any elastic memory in these side portions and the bias of the compressed resilient sleeve 42. Additional outward bias for separating the holster side portions when the screw 46 is loosened is provided by a spring 56 contained within the holster body 12 between the layers 50 of the side portions. This spring will be described in detail presently. Suffice it to say at this point that the spring cooperates with the adjustment sleeve 42 and any elastic memory in the holster body side portions 18, 20 to urge these side portions away from one another when the adjustment screw 46 is loosened.

When a handgun 30 or 32 is positioned in the holster body 12, tightening the adjustment screw 46 urges the holster side portions 18, 20 toward one another to grip the gun between the side portions and thereby secure the gun against falling from the holster or being grabbed from the holster by another person. The force with which the gun is thus gripped and hence the force required to dislodge or remove the gun from the holster may be varied by suitable adjustment of the adjustment screw 46. Loosening the adjustment screw releases the gun for fast front draw and for upward removal from the holster.

Figures 6, 7, 8, 9, 10:
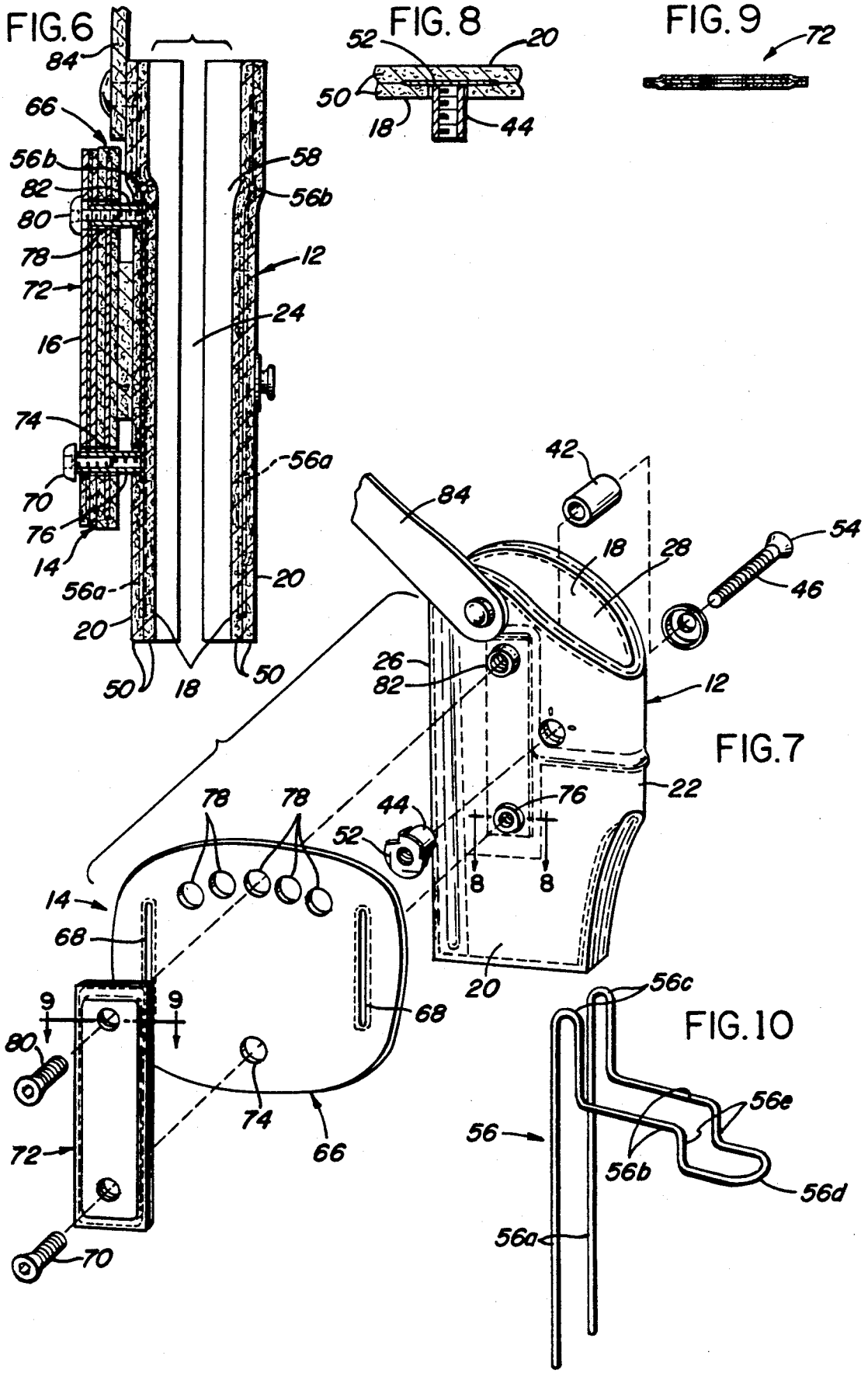
FIG. 6 is an enlarged section taken on line 6—6 in FIG. 2.
FIG. 7 is an exploded perspective view of the holster.
FIG. 8 is an enlarged section taken on line 8—8 in FIG. 7.
FIG. 9 is an enlarged section taken on line 9—9 in FIG. 7.
FIG. 10 is a perspective view of a spring wire embodied in the holster.

Referring to FIG. 10, the holster spring 56 comprises a spring wire or slender spring rod which is bent into the shape shown. As viewed in FIG. 10, the spring has two vertical free end sections **56*a*, two horizontal intermediate sections 56*b* which are located a small distance below and joined at one end by bends 56*c* to the upper ends of the end sections 56*a*, respectively, and a curved center section 56*d*** below and having upstanding ends 56*e* joined to the other ends of the intermediate sections 56*b*. The end sections 56*a* are straight and disposed in relatively close parallel relation. The intermediate sections 56*b* are disposed side by side between the end sections and the curved center section.

The spring 56 is positioned between the two layers 50 of the holster body 12 in such a way that the spring end sections 56*a* extend along the front edges 26 of the inner and outer holster side portions 18, 20, the intermediate spring sections 56*b* extend rearwardly across the side portions, and the curved center section 56*d* extends immediately under the adjustable connection 38 between the side portions and then around the rear web portion 22 of the holster body. The spring is stressed to bias the side portions apart and provide the holster body with a cross-sectional configuration similar to that of FIG. 5 when the adjustment screw 46 is loosened. When the screw is tightened, the side portions are urged toward one another against the bias of the spring to grip the holstered gun. When the screw is loosened, the spring biases the side portions apart to release the gun.

Figure 5:
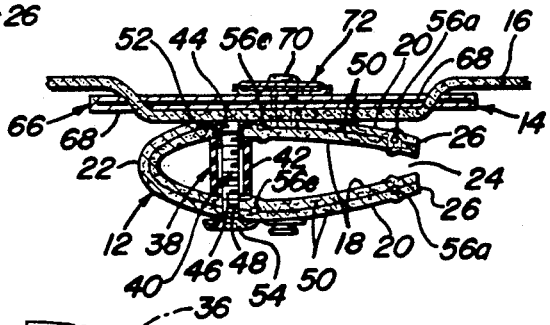
FIG. 5 is a section taken on line 5—5 in FIG. 3.

Referring to FIGS. 3 and 5, the holster is shaped, at least in part by the spring 56, to form a pocket 58 immediately below and opening upwardly through the top opening 28 of the holster for receiving the cylinder 60 of a holstered revolver 30. The adjustable connection 38 between the holster side portions 18, 20 is located so that the trigger guard 32*a* of a holstered pistol rests on this connection, as shown in FIG. 4, to support the pistol in the holster.

Figure 2:
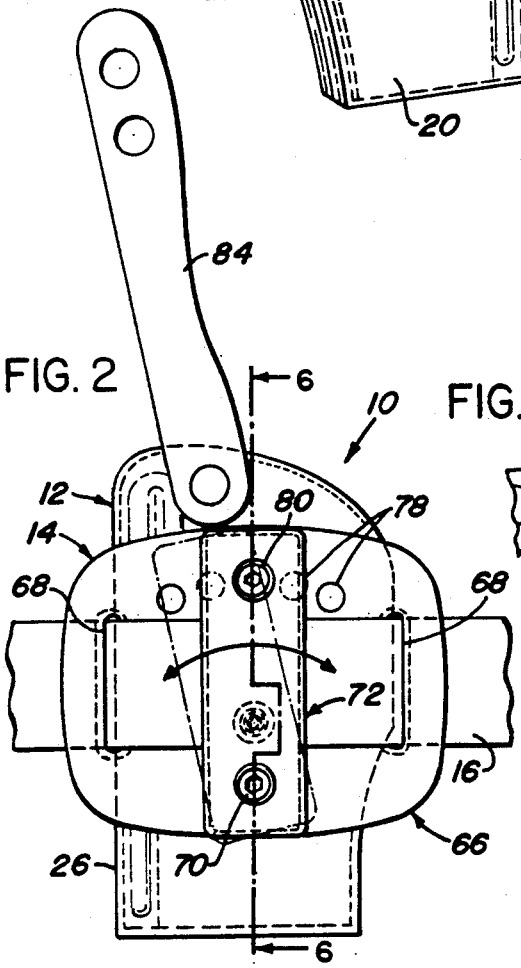
FIG. 2 is a view of the back or inner side of the holster in FIG. 1.

Another improved feature of the invention resides in the unique construction and arrangement of the means 14 for attaching the holster 10 to the wearer, and more specifically to the wearer's belt 16. This attaching means comprises a relatively rigid, plate-like support member 66 having two parallel slots 68 near its left and right ends in FIGS. 2 and 7 for receiving the wearer's belt 16 in the manner best shown in FIG. 5. Support member 66 is pivotally attached to the inner holster portion 18 by a screw 70. This screw extends through the lower end of a relatively rigid, elongate backing member 72 and a hole 74 in the support member 66 near its bottom edge and midway between its belt slots 68 and is threaded in a nut 76 firmly fixed to the inner holster portion 18. Nut 76 is located a distance below the horizontal center line and close to the vertical center line of the holster body, as the holster is viewed in FIGS. 2 and 7. Near the top edge and between the belt slots 68 of the support member 66 are a number of holes 78 spaced along a circular arc centered on the axis of the bottom hole 74 in the member. A screw 80 is insertable through a hole in the upper end of the backing member 72 and any of the holes 78 in the support member 66 and is threadable in a nut 82 fixed to the inner holster portion 18 near its upper edge and aligned endwise of the holster body 12 with the pivot screw nut 76.

From this description, it will be understood that the holster body 12 is pivotally adjustable relative to the holster support member 66 about a pivot axis coinciding with the axis of the pivot screw 70 to adjust the angle of the holster body relative to the wearer's belt 16 and hence relative to the wearer's body. The screw 80 is selectively insertable through any one of the support member holes 78 to secure the holster body in any one of several different angular positons. In this way, each wearer may position the holster at the particular angle that is best for him. The illustrated holster has a strap 84 for firmly securing the holstered gun in the holster except during periods in which it is neccessary that the holstered gun be retained in fast draw readiness. During these periods, the strap 84 will be fixed in a position in which it will not interfere with fast draw of the gun.

In use, the holster 10 is attached to the belt 16 worn about the wearer's waist with the holster body 12 adjusted to the angle which is most convenient to the wearer. A fast front draw of the holstered gun is accomplished by grasping the upper exposed handle 36 of the gun and rotating the handle rearwardly and downwardly while the gun remains in the holster body 12 and in such a way as to rotate the gun barrel 34 forwardly and upwardly through the front opening 24 of the holster body to a firing position in which the barrel extends forwardly through the opening. The edges 26 of the front opening spread against the bias of the holster spring 56 to permit this movement of the gun barrel through the opening. The top opening 28 of the holster slopes downwardly toward the rear edge of the holster body 12, as shown, to accommodate this downward and rearward rotation of the gun handle to fast front draw the gun. The adjustable connection 38 between the holster side portions 18, 20 provides a fulcrum about which the holstered gun may be rotated for fast front draw. The gun may also be withdrawn upwardly from the holster through its top opening 28. In this regard, it was noted earlier that a primary advantage of the improved holster is that it may be both comfortably worn high on the hip and fast fired (i.e. fast front fired) even in a sitting position or other position in which it would be impossible to safely and easily fast draw the gun upwardly from the holster.

The connection 38 between the holster side portions 18, 20 is adjustable to grip the holstered gun with an adjustable force and to release the gun. Thus, the connection may be adjusted to either release the gun for fast front draw or upward removal from the holster or to firmly grip the gun with sufficient force to prevent accidental loss of the gun from the holster during strenuous activiy of the wearer or to prevent grabbing of the gun from the holster by another person. In this regard, the particular holster illustrated is intended for use primarily as a competition holster—that is, for use in competitions which involve both fast firing situations and competition activities which tend to cause accidental loss of the gun from the holster or present the competition risk of the gun being grabbed from the holster by another contestant. It will be appreciated by those versed in the holster art, of course, that the features of the invention may be embodied in a holster for normal law enforcement or other street activities.

The inventor claims:

1. A holster to be worn by a person wearing a belt, comprising:

a holster body having inner and outer sides and inner and outer side walls at said inner and outer sides, respectively, belt engaging means on said inner side wall of said holster body for mounting said holster body on the wearer's belt in various angular positions relative to the belt and securing said holster body against movement along the belt, and wherein said belt engaging means comprises a member at the inner side of said holster body having spaced openings for receiving the wearer's belt in such a way that said member is restrained against movement relative to the belt in all directions except lengthwise of the belt, means pivotally mounting said member on said inner holster body side wall for angular adjustment of said member relative to said holster body on an axis transverse to said holster side walls, means for securing said member against pivoting movement relative to said holster body in any one of several different angular positions relative to said body, and means for releasably securing said member against endwise movement along said belt.

2. A holster to be worn by a person wearing a belt, comprising:

a holster body having inner and outer sides and inner and outer side walls at said inner and outer sides, respectively, belt engaging means on said inner side wall of said holster body for both adjustably securing said holster body to the wearer's belt in various angles relative tot he belt and securing said holster body against movement along the belt, and wherein said belt engaging means comprises a first member at the inner side of said holster body, a second member between said body and said first member for receiving the wearer's belt in such a way that the belt is restrained against movement relative to said second member in all directions except lengthwise of the belt and the belt passes between said members, and means joining said members to said inner side wall of said holster body including means pivotally mounting said second member on said inner side wall for angular adjustment of said second member to various angular positions relative to said holster body on an axis transverse to said holster side walls, and means for securing said second member against pivotal movement relative to said body and urging said members toward one another to grip said belt.

3. A holster to be worn by a person wearing a belt, comprising:

a holster body having inner and outer sides and inner and outer side walls at said inner and outer sides, respectively, belt engaging means on said inner side wall of said holster body for both adjustably securing said holster body to the wearer's belt in various angles relative tot he belt and securing said holster body against movement along the belt, and wherein said belt engaging means comprises: (a) a first member at the inner side of said holster body and a second member between said first member and said body, said second member having two spaced openings through which the wearer's belt may be inserted with the belt passing between said members in the region between said openings, a first hole, and a number of second holes spaced along a circular arc centered on and spaced a certain radial distance from the axis of said first hole; (b) a first nut secured to said inner side wall of the holster body, (c) a first screw extending through a first hole in said first member and said first hole in said second member and threaded in said nut for supporting said second member for pivotal movement about said axis to various angular positions relative to said holster body; (d) a second nut fixed to said inner side wall of said body with its axis spaced said certain radial distance from the axis of said first nut; and (e) a second screw insertable through a second hole in said first member spaced said certain radial distance from said first hole in the first member and through any selected second hole in said second member and threadable in said second nut, and said screws are adapted to be tightened to urge said members toward one another and into gripping relation with said belt.

4. A holster according to claim 3, wherein said holster comprises a front opening, front draw holster.

* * * * *